US010087564B2

(12) United States Patent
Kim et al.

(10) Patent No.: US 10,087,564 B2
(45) Date of Patent: Oct. 2, 2018

(54) LAUNDRY TREATMENT APPARATUS

(71) Applicant: LG ELECTRONICS INC., Seoul (KR)

(72) Inventors: Hyundong Kim, Seoul (KR); Jaehyun Kim, Seoul (KR); Kyeonghwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 559 days.

(21) Appl. No.: 14/634,156

(22) Filed: Feb. 27, 2015

(65) Prior Publication Data

US 2015/0368845 A1 Dec. 24, 2015

(30) Foreign Application Priority Data

Jun. 23, 2014 (KR) ..... 10-2014-0076498

(51) Int. Cl.

| | |
|---|---|
| ***D06F 37/22*** | (2006.01) |
| ***D06F 37/30*** | (2006.01) |
| ***D06F 37/20*** | (2006.01) |
| ***D06F 37/26*** | (2006.01) |

(52) U.S. Cl.

CPC ..... *D06F 37/225* (2013.01)

(58) Field of Classification Search

CPC ..... D06F 37/225

See application file for complete search history.

(56) References Cited

U.S. PATENT DOCUMENTS

| | | | | |
|---|---|---|---|---|
| 5,813,253 | A | 9/1998 | Uhlin | |
| 9,617,676 | B2 * | 4/2017 | Kwon | D06F 37/203 |
| 2012/0084926 | A1 | 4/2012 | Lee et al. | |

(Continued)

FOREIGN PATENT DOCUMENTS

| | | | |
|---|---|---|---|
| CN | 2854871 | Y | 1/2007 |
| CN | 102899847 | A | 1/2013 |
| CN | 103485126 | A | 1/2014 |

(Continued)

OTHER PUBLICATIONS

International Search Report from PCT/KR2015/006349, dated Aug. 27, 2015.

(Continued)

*Primary Examiner* — Michael Barr
*Assistant Examiner* — Benjamin L Osterhout
(74) *Attorney, Agent, or Firm* — Dentons US LLP

(57) ABSTRACT

A laundry treatment apparatus including a cabinet forming an appearance of the apparatus, a drum having a laundry space therein to accommodate laundry, a rotating shaft for rotatably supporting the drum in the cabinet, a balancer including a housing fixed to the drum, an accommodation space defined in the housing, a balancing unit movably provided in the accommodation space, and a housing power line provided in the accommodation space to supply the balancing unit with electric power, a shaft through-hole formed through the rotating shaft, a first power supply unit, fixed to the rotating shaft, including a connection line connected to the housing power line through the shaft through-hole, and a second power supply unit rotatably fixed to the first power supply unit to connect the connection line to a power source.

9 Claims, 7 Drawing Sheets

(56) References Cited

U.S. PATENT DOCUMENTS

| | | | | |
|---|---|---|---|---|
| 2013/0025330 | A1* | 1/2013 | Bae | D06F 37/304 68/140 |
| 2013/0327098 | A1 | 12/2013 | Bae et al. | |

FOREIGN PATENT DOCUMENTS

| | | | |
|---|---|---|---|
| CN | 103781959 | A | 5/2014 |
| EP | 2551398 | A1 | 1/2013 |
| EP | 2671995 | A1 | 12/2013 |
| KR | 10-2011-0010945 | A | 2/2011 |
| KR | 10-2013-0017355 | A | 2/2013 |
| KR | 10-2013-0114478 | A | 10/2013 |
| WO | 2013-022164 | A2 | 2/2013 |
| WO | 2013/183929 | A1 | 12/2013 |
| WO | 2014/200297 | A1 | 12/2014 |

OTHER PUBLICATIONS

Written Opinion of the ISA from PCT/KR2015/006349, dated Aug. 27, 2015.
International Search Report from PCT/KR2015/006352, dated Sep. 23, 2015.
Written Opinion of the ISA from PCT/KR2015/006352, dated Sep. 23, 2015.

* cited by examiner

【Fig. 1】
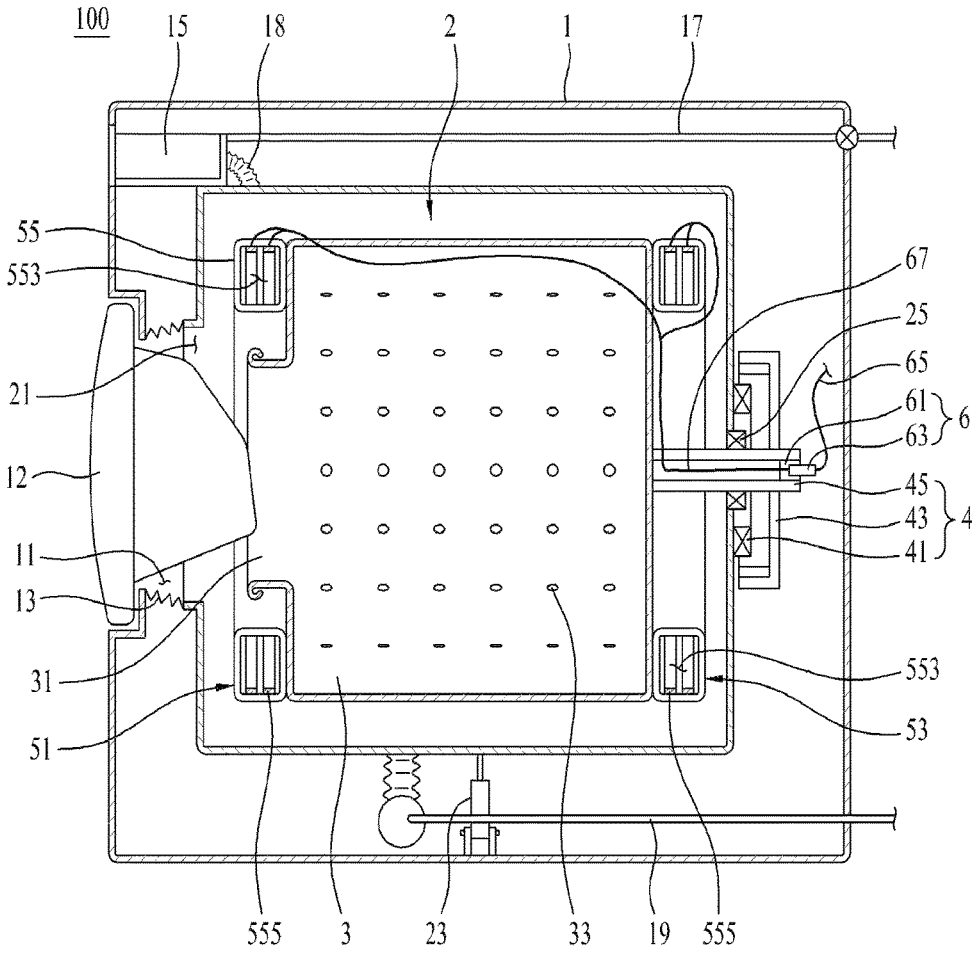

【Fig. 2】
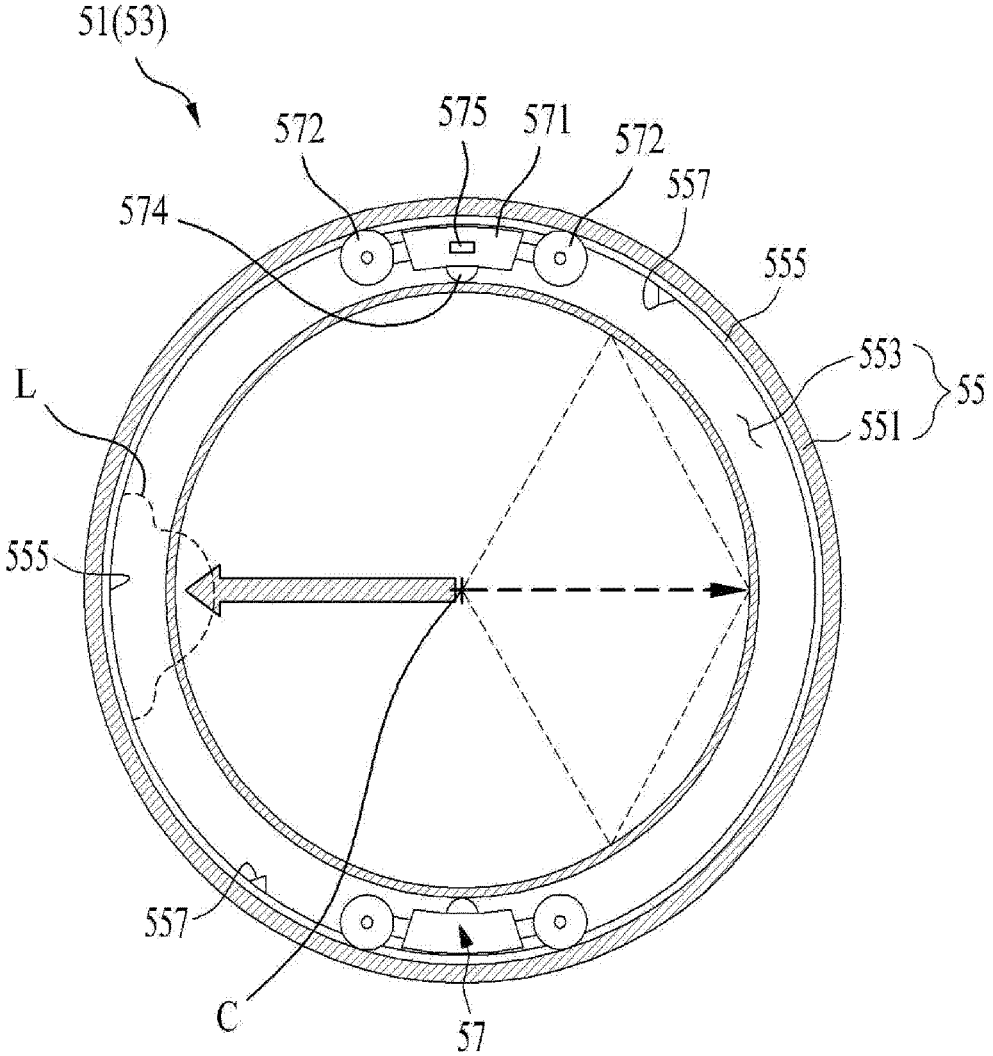

【Fig. 3】
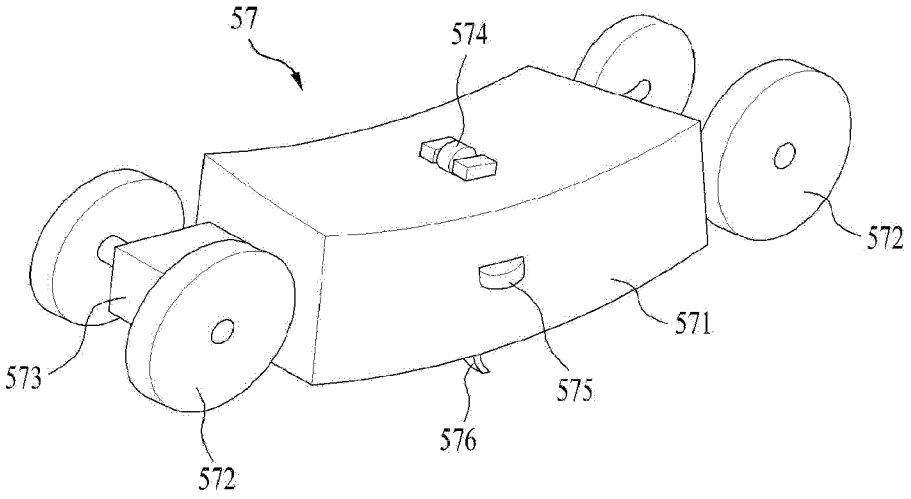
(a)
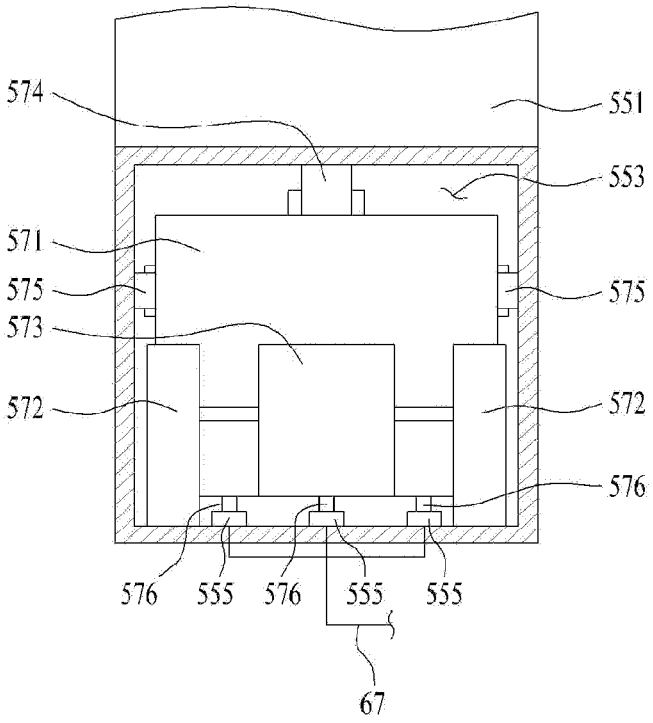
(b)

【Fig. 4】
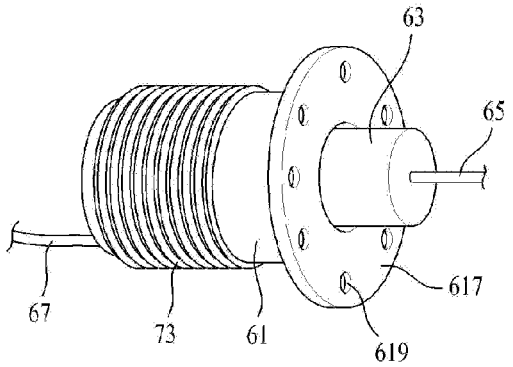
(a)
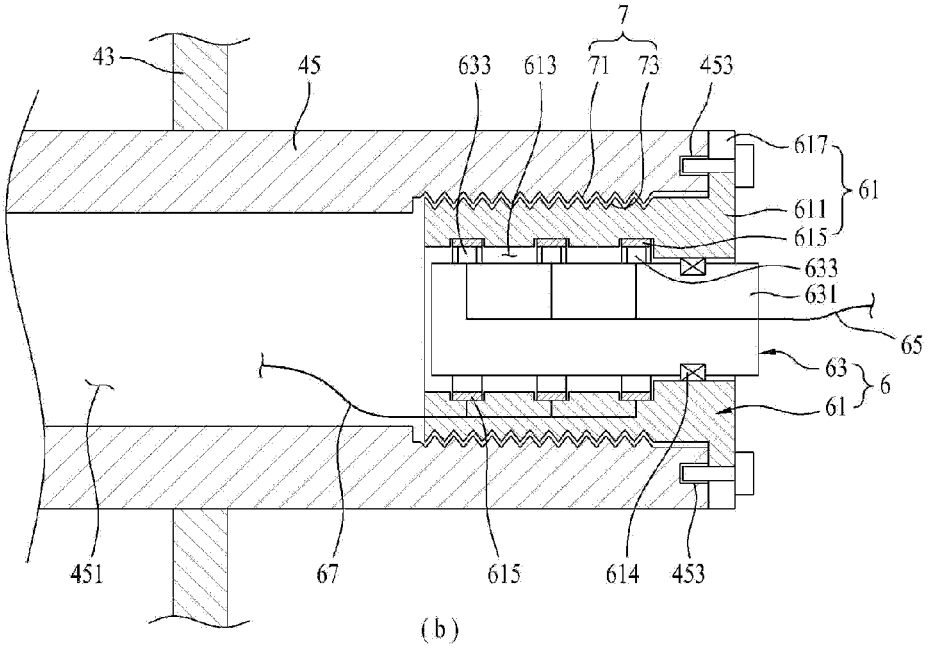
(b)

【Fig. 5】
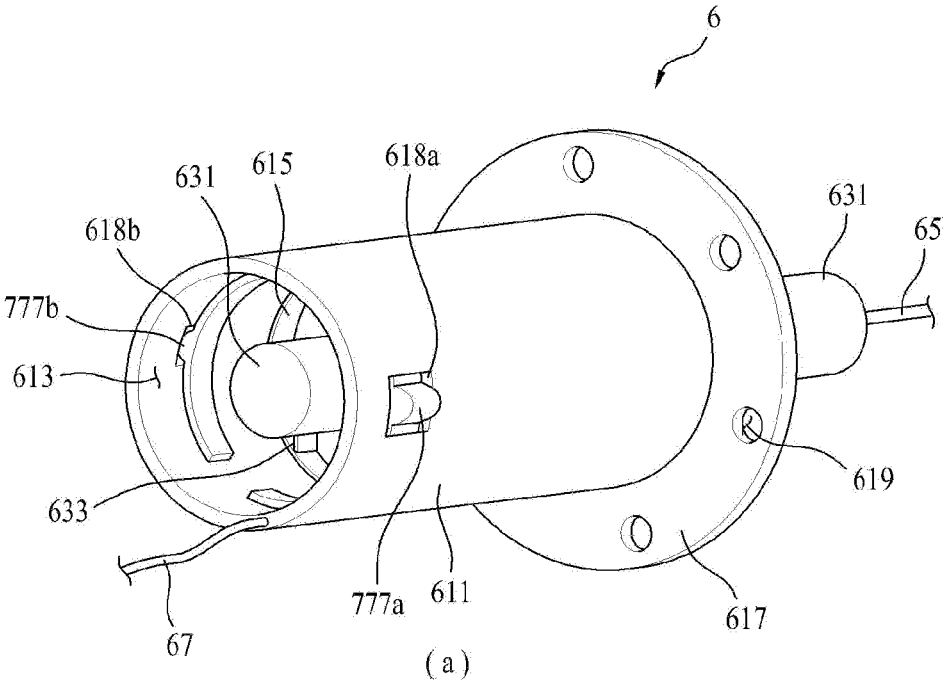
(a)
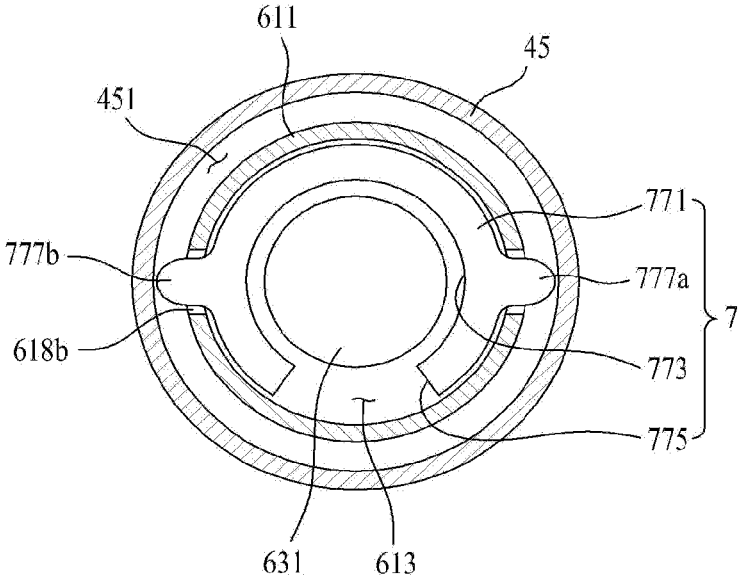
(b)

【Fig. 6】
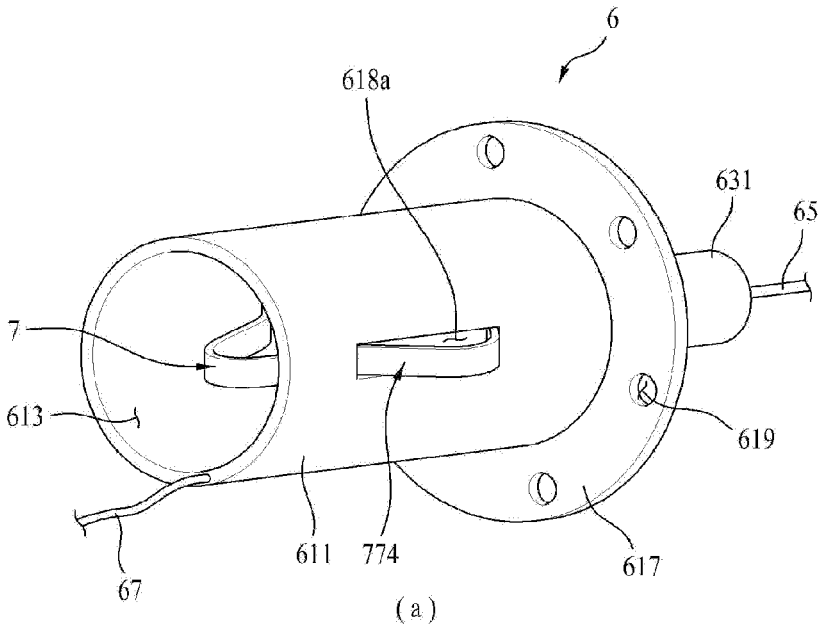
(a)
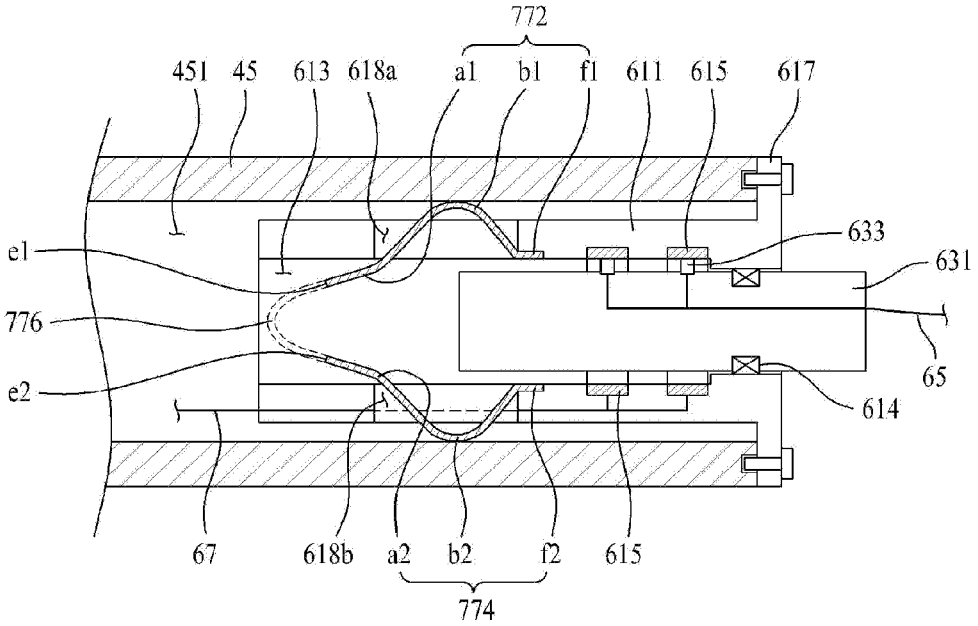
(b)

【Fig. 7】
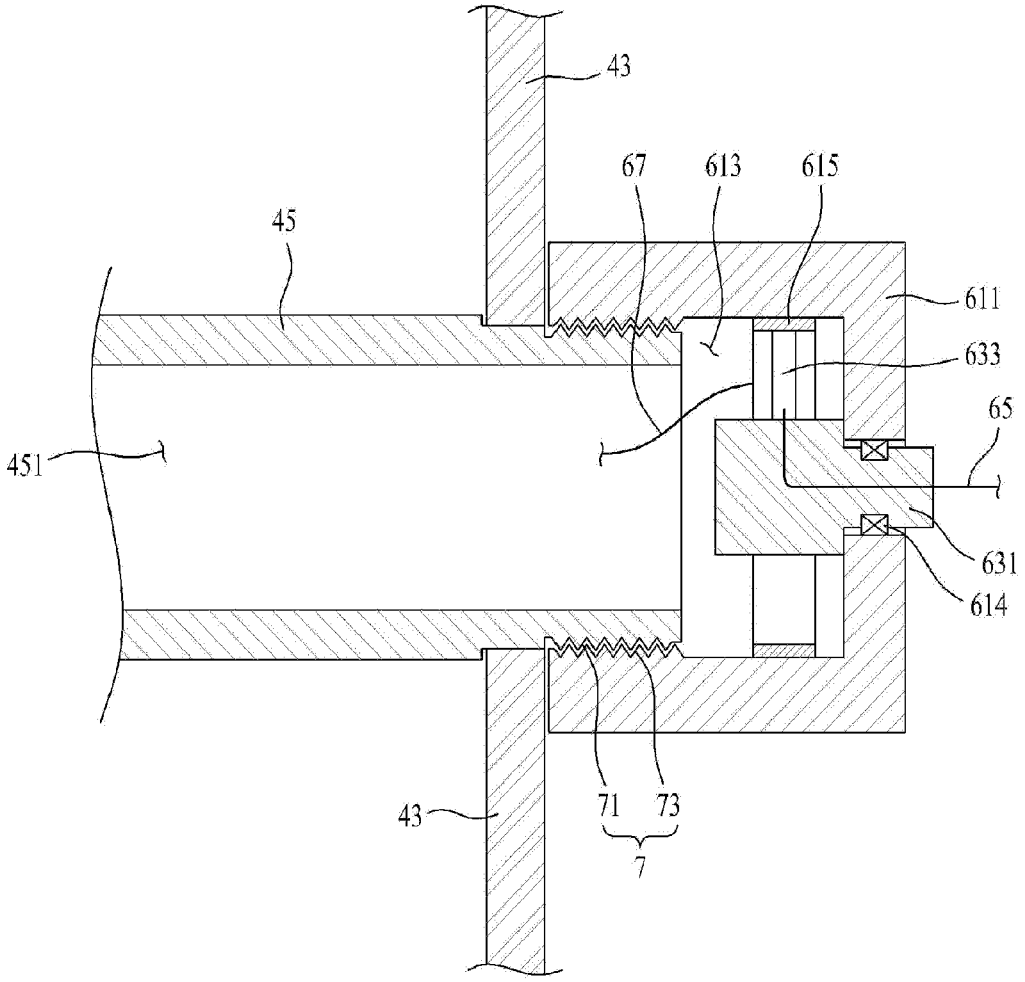

LAUNDRY TREATMENT APPARATUS

Pursuant to 35 U.S.C. § 119(a), this application claims the benefit of earlier filing date and right of priority to Korean Patent Application No. 10-2014-0076498, filed on Jun. 23, 2014, the contents of which are hereby incorporated by reference herein in its entirety.

TECHNICAL FIELD

The present disclosure relates to a laundry treatment apparatus.

BACKGROUND ART

A conventional laundry treatment apparatus includes a cabinet defining an appearance of the apparatus, a tub installed in the cabinet, a drum rotatably installed in the tub to wash laundry, and a motor having a rotating shaft, coupled to the drum while passing through the tub, to rotate the drum.

The drum may rotate without maintaining dynamic equilibrium (dynamic balance) depending on a position of laundry disposed therein.

"Dynamic equilibrium" means a state that, during rotation of a rotating body, a centrifugal force of the rotating body or a moment caused by the centrifugal force becomes zero with respect to the axis of rotation. In case of a rigid body, dynamic equilibrium is maintained when mass of the rigid body is evenly distributed about the axis of rotation.

Accordingly, dynamic equilibrium of a laundry treatment apparatus may be considered as a state in which the mass distribution of laundry about an axis of rotation of a drum including laundry contained therein falls within an allowable range during rotation of the drum (a state in which the drum rotates in an allowable amplitude range of vibration).

Meanwhile, a state wherein the dynamic equilibrium in a laundry treatment apparatus is lost (a state of unbalance) means that mass distribution of laundry about the axis of rotation of a drum is non-uniform during rotation of the drum. The loss of dynamic equilibrium occurs when laundry is not evenly distributed along an inner surface of the drum.

When a drum rotates in an unbalanced state, vibration is generated. The vibration of the drum is transmitted to a tub or a cabinet thus causing generation of noise.

Among conventional laundry treatment apparatuses, there is an apparatus equipped with a balancer for improving an unbalanced state of a drum. A balancer incorporated in conventional laundry treatment apparatuses is a ball balancer or a fluid balancer in which a ball or fluid is contained in a housing fixed to a drum.

When a drum is in the unbalanced state, the drum exhibits the highest rotational speed when laundry incurring the unbalanced state passes through the lowest point of the rotational orbit of the drum and exhibits the lowest rotational speed when the laundry incurring the unbalanced state passes through the highest point of the rotational orbit of the drum.

Therefore, the ball balancer or the fluid balancer incorporated in conventional laundry treatment apparatuses controls unbalanced state in such a manner that a ball or fluid moves toward the lowest point of a rotational orbit of a drum when laundry incurring the unbalanced state moves toward the highest point.

Although the above-mentioned unbalance control is useful under the vibration condition in a steady state in which amplitude of vibration of a drum falls within a predetermined range, satisfactory effects cannot be obtained under transient vibration to which the drum is subjected before vibration of the drum reaches the steady state.

Furthermore, conventional balancing units have difficulty in immediately resolving (actively resolving) unbalanced state upon occurrence of unbalance.

DISCLOSURE

Technical Problem

To solve these problems, one object is to provide a laundry treatment apparatus which is configured to actively resolve unbalanced rotation of a drum containing laundry.

Another object is to provide a laundry treatment apparatus equipped with a balancer including at least two balancing units moving independently (moving in different directions) in a housing fixed to a drum.

A further object is to provide a laundry treatment apparatus which is capable of supplying electric power in a wired manner to at least two balancing units moving independently in a housing fixed to a drum.

Technical Solution

The objects can be achieved by providing a laundry treatment apparatus including a cabinet forming an appearance of the apparatus, a drum having a laundry space therein to accommodate laundry, a rotating shaft for rotatably supporting the drum in the cabinet, a balancer including a housing fixed to the drum, an accommodation space defined in the housing, a balancing unit movably provided in the accommodation space, and a housing power line provided in the accommodation space to supply the balancing unit with electric power, a shaft through-hole formed through the rotating shaft, a first power supply unit fixed to the rotating shaft and including a connection line connected to the housing power line through the shaft through-hole, and a second power supply unit rotatably fixed to the first power supply unit to connect the connection line to a power source.

The first power supply unit may include a first body fitted in the shaft through-hole, a body through-hole formed through the first body, and a first contact element provided at an inner peripheral surface of the body through-hole and connected to the connection line, and the second power supply unit may include a second body fitted in the body through-hole and rotatably supported in the first body, a second contact element provided at the second body and contacting the first contact element, and a power line for connecting the second contact element to the power source.

The first power supply unit may further include a flange provided at an outer peripheral surface of the first body and protruding away from the body through-hole, the flange having a flange through-hole formed therein, and the rotating shaft may include a fastening hole formed at a position corresponding to the flange through-hole.

The first body may have an outer peripheral surface at least partially fitted in the inner peripheral surface of the shaft through-hole.

The apparatus may further include an elastic support protruding from the first body and contacting the shaft through-hole so as to couple the first body to the shaft through-hole.

The first power supply unit may further include through-holes formed in the first body to communicate the body through-hole with the shaft through-hole, and the elastic support may include a C-shaped support body, and protrusions protruding from the support body, the protrusions being disposed in the through-hole and pressed by the shaft through-hole.

The first power supply unit may further include a first through-hole and a second through-hole formed in the first body so as to communicate the body through-hole with the shaft through-hole, wherein the elastic support may include a C-shaped support body, a first protrusion protruding from the support body and disposed in the first through-hole, and a second protrusion protruding from the support body and disposed in the second through-hole, and wherein a distance between a free end of the first protrusion and a free end of the second protrusion may be larger than an inner diameter of the shaft through-hole.

The first power supply unit may further include a through-hole formed in the first body so as to communicate the body through-hole with the shaft through-hole, and the elastic support may include a bar fixed in the body through-hole, and a bent portion disposed in the through-hole and contacting the shaft through-hole.

The first power supply unit may further include a first through-hole and a second through-hole formed in the first body so as to communicate the body through-hole with the outside of the first body, and the elastic support may include a first support including a first bar fixed in the body through-hole, and a first bent portion disposed in the first through-hole and contacting the shaft through-hole, and a second support including a second bar fixed in the body through-hole, and a second bent portion disposed in the second through-hole and contacting the shaft through-hole.

A distance between a free end of the first bent portion and a free end of the second bent portion may be larger than an inner diameter of the shaft through-hole.

The first bar may include a first stationary end fixed to the first body and a first free end disposed in the body through-hole, and the second bar may include a second stationary end fixed to the first body and a second free end disposed in the body through-hole.

The apparatus may further include a connection section disposed in the body through-hole for connecting the first free end with the second free end.

The apparatus may further include a stator disposed in the cabinet to generate a rotating magnetic field, and a rotor which is rotated by the rotating magnetic field generated from the stator, wherein the first power supply unit may include a first body coupled to an outer peripheral surface of the rotating shaft to secure the rotor to the rotating shaft, a body through-hole formed through the first body, and a first contact element disposed at an inner peripheral surface of the body through-hole and connected to the connection line, and wherein the second power supply unit may include a second body disposed in the body through-hole and rotatably fitted in the first body, a second contact element provided at the second body and contacting the first contact element, and a power line for connecting the second contact element to the power source.

Advantageous Effects

The present invention can provide a laundry treatment apparatus which is configured to actively resolve unbalanced rotation of a drum containing laundry.

Furthermore, the present invention can provide a laundry treatment apparatus equipped with a balancer including at least two balancing units moving independently (moving in directions different from each other) in a housing fixed to a drum.

Additionally, the present invention can provide a laundry treatment apparatus which is capable of supplying electric power in a wired manner to at least two balancing units moving independently in a housing fixed to a drum.

DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a view illustrating a laundry treatment apparatus according to the present invention;

FIG. 2 is a view illustrating a balancer incorporated in the laundry treatment apparatus according to the present invention;

FIG. 3 is a view illustrating balancing units incorporated in the laundry treatment apparatus according to the present invention; and FIGS. 4 to 7 are views illustrating a power supply incorporated in the laundry treatment apparatus according to the present invention.

DETAILED DESCRIPTION

Reference will now be made in detail to the preferred embodiments of the present invention, examples of which are illustrated in the accompanying drawings. It should be noted herein that construction of an apparatus, which will hereinafter be described, and a control method of the apparatus are given only for illustrative purposes and the protection scope of the invention is not limited thereto. Wherever possible, the same reference numbers will be used throughout the drawings to refer to the same or like parts.

FIG. 1 illustrates a laundry treatment apparatus according to the present invention. As shown in FIG. 1, a laundry treatment apparatus 100 according to the present invention includes a cabinet 1 defining an appearance of the apparatus, a tub 2 provided at cabinet 1, a drum 3 rotatably provided at the tub 2 to receive laundry, and balancers 51 and 53 provided at drum 3 to attenuate unbalance of drum 3.

Cabinet 1 includes an introduction port 11 for allowing introduction and retrieval of laundry, and a door 12 for opening and closing introduction port 11.

Tub 2 defines therein a space for accommodating washing water, and includes a tub inlet 21 communicating with introduction port 11. Tub 2 is secured in the cabinet 1 via a tub support 23. Tub support 23 serves to attenuate vibration generated from tub 2 by means of a damper or a spring.

A gasket 13 may be provided between the introduction port 11 and the tub inlet 21. The gasket 13 is intended to prevent the washing water in the tub from leaking into cabinet 1, and is preferably made of a resilient material so as to block transmission of vibration of the 2 to cabinet 1.

Meanwhile, cabinet 1 may further be provided with a water supply pipe 17 for allowing washing water to be supplied into tub 2, and a water discharge pipe 19 for allowing the washing water in tub 2 to be discharged from cabinet 1.

In addition, cabinet 1 may further include a detergent box 15 for supplying detergent into the tub 2. Detergent box 15 may be embodied as a drawer type box that may be pulled out of a front surface of cabinet 1 (the surface of cabinet 1 at which introduction port 11 is provided).

Detergent box 15 may be connected to a water supply source (not shown) via water supply pipe 17, and may be connected to tub 2 via a detergent supply pipe 18. Consequently, as washing water is supplied through water supply pipe 17, detergent stored in the detergent box 15 is supplied into tub 2 through detergent supply pipe 18.

Drum 3 includes a drum inlet 31 communicating with tub inlet 21. Laundry may be put into or taken out of drum 3 through introduction port 11, tub inlet 21, and drum inlet 31.

Drum 3 includes a plurality of drum through-holes 33 that are perforated through a circumferential wall of drum 3. Drum through-holes 33 are intended not only to allow the washing water in tub 2 to be introduced into drum 3 but also to allow washing water extracted from laundry to be discharged into tub 2.

Drum 3 is rotated by means of a drive unit 4 which is provided outside tub 2.

Drive unit 4 may include a stator 41 fixed to a rear surface of tub 2, a rotor 43 adapted to be rotated by a rotating magnetic field generated from the stator 41, and a rotating shaft 45 which extends through the rear surface of tub 2 so as to connect drum 3 to rotor 43. In this case, tub 2 may further include a shaft bearing 25 for rotatably supporting rotating shaft 45.

Meanwhile, drum 3 is provided with balancers 51 and 53 that serve to control vibration generated from drum 3. In this regard, such a balancer may be provided at one of front and rear surfaces of drum 3, or may be provided at both the front and rear surfaces of drum 3.

FIG. 1 illustrates an example in which both the balancers are provided, that is, the front balancer 51 is provided at the front surface of drum 3 and the rear balancer 53 is provided at the rear surface of drum 3.

Since the front balancer 51 and the rear balancer 53 have the same internal configuration except for positions thereof, the configuration of a balancer which will be described hereinafter may be applied to both the front and rear balancers.

FIG. 2 illustrates a balancer incorporated in the laundry treatment apparatus according to the present invention. As shown in FIG. 2, the balancer includes a housing 55 fixed to drum 3, and balancing units 57 movably provided at the housing 55.

Housing 55 includes a housing body 551 fixed to the drum 3, and an accommodation space 553 defined in the housing body 551 and exhibiting a circular orbit.

Housing body 551 may be embodied as any configuration so long as such configuration does not close the drum inlet 31. FIG. 2 illustrates the housing body 551 which is embodied into an annular shape by way of example.

Although the accommodation space 553 is preferably shaped into a true circle that has a constant radius, it may be embodied into an imperfect circle (an elliptical shape and the like) having a varying radius that is locally different if the balancing units 57 are movable.

Accommodation space 553 is provided at an internal surface thereof with housing power lines 555 which are connected to a power supply 6 to be described later. Housing power lines 555 may further be provided with protrusions 557 or grooves (not shown) so as to bring about variation in an amount of current.

Protrusions 557 or the grooves (not shown) may be formed into any shape as long as they cause variation in cross-sectional area of the housing power lines 555. Protrusions 557 or the grooves (not shown) are provided so as to enable a control unit (not shown) to detect positions of the balancing units 57, and a detailed description thereof will be given later.

The number of balancing units 57 according to the present invention is preferably at least of two in order to prevent unbalance of drum 3 caused by the balancing units 57. The essential constructions of the balancing units 57 may be the same.

FIG. 3 illustrates balancing units incorporated in the laundry treatment apparatus according to the present invention. As shown in FIG. 3(*a*), the balancing unit 57 includes a unit body 571 that is sized to be movable along accommodation space 553, a motor 573 provided at the unit body 571, and wheels 572 adapted to support the unit body 571 and being rotated by motor 573, and unit power lines 576 provided at the unit body 571 to supply electric power (electric energy) supplied from housing power lines 555 to motor 573.

Wheels 572 may be provided at the front and the rear of unit body 571, and motor 573 may be constructed to drive only one pair of wheels of the front pair and rear pair of wheels 572.

Unit body 571 may be provided at any one of a top surface and both lateral surfaces thereof with a spacer such that a constant spacing is maintained between an external surface of unit body 571 and the internal surface of the housing body 551.

FIG. 3(*b*) illustrates an example in which the spacer includes a first subsidiary wheel 574 provided at the top surface of unit body 571, and second subsidiary wheels 575 provided at opposite lateral surfaces of unit body 571, respectively.

The first subsidiary wheel 574 and the second subsidiary wheels 575 are preferably rotatably provided at the unit body 571.

In this example, housing power lines 555 may be secured to the inner surface of accommodation space 553 such that they are positioned under the unit body 571 or at the opposite lateral surfaces of the unit body 571.

Since the unit power lines 576 are secured to the unit body 571 while being in contact with the housing power lines 555, the unit power lines 576 are held in a state of contacting the housing power lines 555 regardless of the position of balancing unit 57 in the accommodation space 553 (even though the balancing unit 57 moves along the accommodation space 553). Consequently, the balancing unit 57 which moves in the accommodation space 553 may be supplied with electric power from the housing power lines 555 through the unit power lines 576.

Meanwhile, balancing unit 57 provided at the laundry treatment apparatus according to the present invention may further include a unit controller (not shown) for controlling operation of motor 573 and a unit communicator (not shown) for transmission and reception of data.

In this case, the laundry treatment apparatus according to the present invention may further include a control unit (not shown) for controlling the drive unit 4 or supply and discharge of washing water (opening and closing of the water supply pipe or the water discharge pipe) and a communication unit (not shown) for exchange of data with the unit communicator (not shown).

Accordingly, when unbalance occurs at drum 3, the control unit (not shown) transmits control data to the unit communicator through the communication unit (not shown) so as to move balancing unit 57 to a position at which unbalance is attenuated. Based on the control data received at the unit communicator, the unit controller moves balancing unit 57 to a predetermined position (at which unbalance is attenuated), thus attenuating unbalance caused by the drum.

As shown in FIG. 1, housing power lines 555 are supplied with electric power from a power source through power supply 6. As shown in FIG. 4, the power supply 6 may include a first power supply unit 61 fixed to rotating shaft 45 and connected to the housing power lines 555 (electrical connection), and a second power supply unit 63 rotatably fitted in the first power supply unit 61 to connect the power supply (electric power supply) to the housing power lines 555.

The first power supply unit 61 may include a first body 611, an outer surface of which is fitted in a shaft through-hole 451, and a body through-hole 613 formed through the first body 611.

First body 611 may be formed into various shapes capable of being fitted in the shaft through-hole 451. FIG. 4 illustrates an example in which the first body has a cylindrical shape.

First body 611 is coupled to rotating shaft 45 by means of a coupling unit 7.

FIG. 4 illustrates the coupling unit 7 which includes a male threaded section 71 formed on an outer peripheral surface of the first body 611, and a female threaded section 73 formed on an inner peripheral surface of the shaft through-hole 451.

The body through-hole 613 is longitudinally formed along the first body 611 and communicates with shaft through-hole 451. First contact elements 615 are fixed to an inner peripheral surface of the body through-hole 613.

First contact elements 615 should be made of conductors that allow flow of electrical current. Connected to the first contact element 615 is a connection line 67. Connection line 67 serves to connect first contact element 615 to housing power lines 555.

Rotating shaft 45 extends through the rear surface of tub 2 and is fixed to drum 3. Since shaft through-hole 451 is longitudinally formed through rotating shaft 45, connection lines 67 which are disposed in the shaft through-hole 451 may extend to the housing power lines 555 disposed in the balancers 51 and 53.

Second power supply unit 63 includes a second body 631 rotatably fitted in the body through-hole 613, and second contact elements 633 provided at the second body 631 to contact the first contact elements 615.

Second body 631 may be formed into any shape that is rotatable in the body through-hole 613. FIG. 4 illustrates an example in which the second body 631 has a cylindrical shape.

Second body 631 is rotatably fitted in the body through-hole 613 via a bearing 614 secured to the inner peripheral surface of the body through-hole 613.

Second contact elements 633 should be made of conductors fixed to the second body 631, respectively, and are connected to a power source through a power line 65.

In the laundry treatment apparatus according to the present invention having the above-described configuration, since the rotating shaft 45 and the first power supply unit 61 rotate together with drum 4 whereas the second power supply unit 63 connected to the power source is rotatably fitted in the first power supply unit 61, there is no occasion that connection line 67 is twisted or entangled even though drum 3 rotates. Consequently, the present invention enables the balancing units 57 moving in the balancers to be supplied with electric power in a wired manner, that is, through connection line 67.

Power supply 6 provided according to the present invention may further include a flange 617 provided at the first power supply unit 61, through-holes 619 formed through flange 619, and fastening holes 453 formed at rotating shaft 45, in order to firmly fasten the first power supply unit 61 to the rotating shaft 45.

Flange 617 may extend from an outer peripheral surface of the first body 611 (protruding away from the shaft through-hole 451). Flange through-holes 619 are formed through flange 617 such that they communicate with fastening holes 453.

Tightening bolts inserted through the flange through-holes 601 into the fastening holes 453 enable the first body 611 to be more firmly fastened to the shaft through-hole 451.

FIG. 5 illustrates a power supply 6 which is provided according to another embodiment of the present invention.

Power supply 6 according to this embodiment also includes a first power supply unit 61 fitted in the shaft through-hole 451 of the rotating shaft and connected to the housing power lines 555, and a second power supply unit 63 rotatably fitted in the first power supply unit 61 and electrically connected to the power source and the first power supply unit 61.

The first power supply unit 61 according to this embodiment may include a first body 611 fitted in the shaft through-hole 451, a body through-hole 613 formed through first body 611, and a first contact element 615 fixed to an inner peripheral surface of the body through-hole 613 and connected to the housing power lines 555 via connection line 67.

Second power supply unit 63 may include a second body 631 rotatably disposed in the body through-hole 613, and a second contact element 633 provided at the second body 631 to contact the first contact element 615. Second body 631 is constructed to have the same configuration as that shown in FIG. 4, and is rotatably fitted in the first body 611.

Since the second contact element 633 is connected to power source through the power line 65, electric power from the power source is supplied to the housing power lines 555 through power line 65, second contact element 633, first contact element 631, and connection line 67.

Meanwhile, power supply 6 is coupled to rotating shaft 45 by means of a coupling unit 7. Coupling unit 7 may be composed of an elastic support that protrudes from the surface of the first body 611 to retain first body 611 in the shaft through-hole 451.

The elastic supports may include a C-shaped support body 771 disposed in the body through-hole 613, and protrusions 777*a* and 777*b* protruding outward from support body 771 through the body 611.

In order to allow protrusions 777*a* and 777*b* disposed in the body through-hole 613 to protrude outward from the first body 611, first power supply unit 61 may further include through-holes 618*a* and 618*b* formed in the first body 611.

The protrusion may be composed of only one single protrusion, for example, the protrusion 777*a* may protrude from the outer peripheral surface of the support body 771. Alternatively, a pair of protrusions 777*a* and 777*b* may protrude from the outer peripheral surface of the support body 771 as illustrated in FIG. 5. The distance between the free end of the protrusion 777*a* and the free end of second protrusion 777*b* is larger than the diameter of the shaft through-hole.

While FIG. 5 illustrates the case in which first protrusion 777*a* and second protrusion 777*b* are positioned to be opposite to each other with respect to the center of a through-hole 773, there is no need to restrict the position of the respective protrusion to those shown in FIG. 5.

Support body 771 is composed of an annular metal body (elastic body) that has through-hole 773 formed therein and a cut sector 775 opened to allow the through-hole 773 to communicate with the outside. Consequently, when external force acting toward the center of the through-hole 773 is applied to protrusions 777*a* and 777*b* and thus support body 771 is deformed (the diameter of the through-hole 771 is varied), support body 771 will exert restoring force to restore to the original structure.

More specifically, in power supply 6 according to this embodiment, when first body 611 is inserted into shaft through-hole 451, protrusions 777*a* and 777*b* are pressed toward the center of through-hole 773 due to the inner peripheral surface of the shaft through-hole 451. In this state, restoring force of support body 771 maintains the respective protrusions 777*a* and 777*b* in contact with the inner peripheral surface of the shaft through-hole 451. Therefore, first body 611 is held with respect to rotating shaft 45 owing to the frictional force generated between each of protrusions 777*a* and 777*b* and shaft through-hole 451.

Similar to the above embodiment, first body 611 may also be provided at the outer peripheral surface thereof with the flange 617 having flange through-holes 619. Additionally, the rotating shaft 45 may include fastening holes 453 into which bolts are screwed through flange through-holes 619.

Power supply 6 shown in FIG. 6 is constructed to be almost identical to the power supply shown in FIG. 5, except for an elastic support.

The elastic support provided according to this embodiment includes a first support 772 and a second support 774 which are fixedly disposed in the body through-hole 613 and protrude outward from the first body 611 through through-holes 618*a* and 618*b* thus contacting the inner peripheral surface of the shaft through-hole 451.

First support 772 is composed of a first bar a1. The first bar a1 has a stationary end f1 fixedly disposed, and a free end e1 of the first bar a1 freely disposed in the body through-hole 613.

A first bent portion b1 is provided between the first stationary end f1 and the free end e1, and protrudes outward from first body 611 through the through-hole 618*a*.

Second support 774 may have the same structure as that of first support 772. More specifically, second support 774 is also composed of a second bar a2. The second bar a2 may include a second stationary end f2 fixedly disposed in the body through-hole 613, a free end e2 freely disposed in the body through-hole 613, and a second bent portion b2 provided between the second stationary end f2 and the second free end e2 and protruding outward from first body 611 through second through-hole 618*b*.

In power supply 6 according to this embodiment, when first body 611 is inserted into shaft through-hole 451, bent portions b1 and b2 are pressed toward the center of the body through-hole 613 due to rotating shaft 45.

Meanwhile, first and second bars a1, a2 are composed of an elastic body such as a metal body and fixed in the body through-hole 613 by means of stationary ends f1, f2 thereof, and, as such, the first and second bent portions b1 and b2 are maintained in the state that they are in contact with shaft through-hole 451. Therefore, this embodiment enables the body 611 to be held in place in the rotating shaft 45 by means of frictional force generated between each of the first and second bent portions b1 and b2 and the shaft through-hole 451.

In some cases, the elastic support may be composed of only one of the first and second support 772 and 774, and the first and second free ends e1 and e2 may be connected to each other via a connection section 776.

Similar to the above embodiments, according to this embodiment, first body 611 may also include flange 617 which is formed on an outer peripheral surface of the body 611 and has flange through-holes 619, and rotating shaft 45 may also include fastening holes 453 into which bolts are screwed through flange through-holes 619.

FIG. 7 illustrates a power supply 6 according to a further embodiment of the present invention. Power supply 6 according to this embodiment is discriminated from the above embodiments in that power supply 6 serves as not only a unit for supplying electric power to housing power lines 555 but also a unit for securing rotor 43 to rotating shaft 45.

Power supply 6 according to this embodiment may include a first power supply unit 61 fixed to rotating shaft 45, which secures rotor 43 to rotating shaft 45 and is connected to housing power lines 555, and a second power supply unit 63 rotatably fitted in the first power supply unit 61 to connect housing power lines 555 to the power source.

First power supply unit 61 includes a first body 611 coupled to the outer peripheral surface of rotating shaft 45 so as to secure rotor 43 to rotating shaft 45, a body through-hole 613 formed through first body 611, and a first contact element 615 disposed along the peripheral surface of body through-hole 613 and connected to connection line 67.

First body 611 is coupled to rotating shaft 45 by means of coupling unit 7. Coupling unit 7 may include a female threaded section 73 formed on a peripheral surface of the body through-hole 613, and a male threaded section 71 provided at an outer peripheral surface of rotating shaft 45 and threaded with the female threaded section 63.

Meanwhile, second power supply unit 63 may include a second body 631 rotatably fitted in first body 611 and disposed in the body through-hole 613, a second contact element 633 provided at second body 631 so as to contact first contact element 615, and a power line 65 for connecting the second contact element to the power source.

While the above embodiments have been described in connection with the laundry treatment apparatus 100 capable of washing clothes, the present invention may also be applied to a laundry treatment apparatus that is constructed only for the purpose of drying laundry.

Although the laundry treatment apparatus that is constructed only for the purpose of drying laundry may not need tub 2, cabinet 1 should be further provided therein with a drum support (not shown) for supporting rotating shaft 45 and a hot air supply device (not shown) for supplying hot air into the drum.

The drum support (not shown) may be constructed into any configuration so long as such configuration may support drum 3 in the inside of cabinet 1. In this case, rotating shaft 45 has to extend through the drum support while stator 41 has to be fixed to the drum support.

Hereinafter, a process of controlling unbalance (vibration) of the laundry treatment apparatus 100 which is configured in the above-described manner will be described with reference to FIG. 2.

When laundry L is not evenly distributed along an inner peripheral surface of drum 3 but is locally concentrated at a partial area of drum 3, the drum rotates in an unbalanced state in which the drum generates vibration exceeding an allowable vibration range.

Whether or not drum 3 is in the unbalanced state may be determined in various ways. In an example, the unbalanced state may be determined by detecting a rotational speed of rotor 43 by a control unit (not shown) (the control unit receives data as to rotational speed of the rotor from a rotational speed-detecting unit).

The drum in the unbalanced state exhibits the highest rotational speed when laundry incurring the unbalanced state passes through the lowest point of the rotational orbit of the drum, and exhibits the lowest rotational speed when the laundry incurring the unbalanced state passes through the highest point of the rotational orbit of the drum.

Accordingly, in the case of a laundry treatment apparatus which determines whether a drum is in the unbalanced state by means of a unit for detecting a rotational speed of a rotor, it may also be possible to detect a position of laundry incurring the unbalance.

In this regard, when the unbalanced state of the drum and the position of laundry incurring the unbalance are detected, the control unit (not shown) transmits control data (control commands) to balancing units 57 through the communication unit (not shown) and the unit communicator (not shown) (preferably through wireless transmission) so as to move balancing unit 57 to a position at which the unbalanced state is attenuated.

In other words, the unit controller (not shown) moves the balancing units 57 such that the force caused by laundry is attenuated (compensated) by the sum of forces caused by weights of balancing units 57 (the balancing units move such that the force caused by the weights of balancing units 57 is exerted in a direction opposite to the laundry), as illustrated in FIG. 2.

As described above, power required to move the balancing units 57 is supplied from power supply 6 through housing power lines 555 and unit power lines 576.

More specifically, power line 65 supplies electric power to second contact element 633 provided at the second power supply unit 63, and second contact element 633 transmits the electric power to the first contact element 615 of the first power supply unit which is configured to rotate with drum 3. First contact element 615 supplies electric power to housing power lines 555 provided in accommodation space 553 through connection line 67. Balancing units 57 receive the electric power from housing power lines 555 through unit power lines 576.

Meanwhile, in order to control a moving distance or a moving direction of balancing unit 57, the control unit (not shown) (or the unit controller) has to determine a current position of balancing unit 57. According to the present invention, the control unit (not shown) may determine a current position of balancing unit 57 by means of protrusions 557 or the grooves (not shown) provided at housing power lines 555.

Electrical current flowing through a conductor varies in magnitude at a portion of the conductor at which shape of the conductor is deformed. Accordingly, if the unit controller (not shown) measures a magnitude of electrical current supplied to motor 573 and then transmits the measured magnitude to the control unit (not shown), the control unit (not shown) may determine positions of the balancing units.

In particular, when the number of protrusions 557 (or grooves) formed on housing power lines 555 is two (the protrusions 557 are spaced apart from each other by 180 degrees), the control unit (not shown) may move each balancing units 57 to the corresponding protrusion 557 (each balancing unit is moved to an initial position) whenever the unbalanced state is released (whenever rotation of the drum is stopped).

The reason for this is to prevent the unbalanced state caused by balancing units 57 when the drum is rotated again after the unbalanced state is released (rotation of the drum is stopped).

Mode for Invention

Various embodiments have been described in the best mode for carrying out the invention.

INDUSTRIAL APPLICABILITY

The present invention provides a laundry treatment apparatus which is configured to actively resolve unbalanced rotation of a drum containing laundry.

It will be apparent to those skilled in the art that various modifications and variations may be made in the present invention without departing from the spirit or scope of the inventions.

We claim:

1. A laundry treatment apparatus comprising:
- a cabinet forming an appearance of the apparatus;
- a drum having a laundry space therein to accommodate laundry;
- a rotating shaft for rotatably supporting the drum in the cabinet;
- a balancer comprising:
  - a housing fixed to the drum,
  - an accommodation space defined in the housing,
  - a balancing unit movably provided in the accommodation space, and
  - a housing power line provided in the accommodation space to supply the balancing unit with electric power;
- a shaft through-hole formed through the rotating shaft;
- a first power supply unit, fixed to the rotating shaft, including a connection line connected to the housing power line through the shaft through-hole, the first power supply unit comprising:
  - a first body fitted in the shaft through-hole, the first body having an outer peripheral surface at least partially fitted in an inner peripheral surface of the shaft through-hole;
  - a body through-hole formed through the first body; and
  - a first contact element provided at an inner peripheral surface of the body through-hole and connected to the connection line;
- a second power supply unit rotatably fixed to the first power supply unit to connect the connection line to a power source, the second power supply unit comprising:
  - a second body fitted in the body through-hole and rotatably supported in the first body;
  - a second contact element provided at the second body and being in contact with the first contact element; and a power line for connecting the second contact element to the power source; and
- an elastic support protruding from the first body and contacting the shaft through-hole so as to couple the first body to the shaft through-hole.

2. The apparatus of claim 1, wherein:
- the first power supply unit further comprises through-holes formed in the first body to communicate the body through-hole with the shaft through-hole, and
- the elastic support comprises a C-shaped support body, and protrusions protruding from the support body, the protrusions being disposed in the body through-hole and pressed by the shaft through-hole.

3. The apparatus of claim 1, wherein:

the first power supply unit further comprises a first through-hole and a second through-hole formed in the first body so as to communicate the body through-hole with the shaft through-hole, and the elastic support comprises:

a C-shaped support body;

a first protrusion protruding from the support body and disposed in the first through-hole; and a second protrusion protruding from the support body and disposed in the second through-hole, wherein a distance between a free end of the first protrusion and a free end of the second protrusion is larger than an inner diameter of the shaft through-hole.

4. The apparatus of claim 1, wherein:

the first power supply unit further comprises a through-hole formed in the first body so as to communicate the body through-hole with the shaft through-hole; and the elastic support comprises:

a bar fixed in the body through-hole; and a bent portion disposed in the through-hole and contacting the shaft through-hole.

5. The apparatus of claim 1, further comprising:

a stator disposed in the cabinet to generate a rotating magnetic field; and a rotor which is rotated by the rotating magnetic field generated from the stator, wherein the first power supply unit comprises a first body coupled to an outer peripheral surface of the rotating shaft to secure the rotor to the rotating shaft, a body through-hole formed through the first body, and a first contact element disposed at an inner peripheral surface of the body through-hole and connected to the connection line, and wherein the second power supply unit comprises a second body disposed in the body through-hole and rotatably fitted in the first body, a second contact element provided at the second body and contacting the first contact element, and a power line for connecting the second contact element to the power source.

6. The apparatus of claim 1, wherein:

the first power supply unit further comprises a first through-hole and a second through-hole formed in the first body so as to communicate the body through-hole with the outside of the first body, and the elastic support comprises:

a first support comprising a first bar fixed in the body through-hole, and a first bent portion disposed in the first through-hole and contacting the shaft through-hole; and a second support comprising a second bar fixed in the body through-hole, and a second bent portion disposed in the second through-hole and contacting the shaft throughhole.

7. The apparatus of claim 6, wherein a distance between a free end of the first bent portion and a free end of the second bent portion is larger than an inner diameter of the shaft through-hole.

8. The apparatus of claim 6, wherein:

the first bar comprises a first stationary end fixed to the first body and a first free end disposed in the body through-hole; and the second bar comprises a second stationary end fixed to the first body and a second free end disposed in the body through-hole.

9. The apparatus of claim 8, further comprising:

a connection section disposed in the body through-hole for connecting the first free end to the second free end.

* * * * *